US006739533B2

(12) United States Patent
Eckerman et al.

(10) Patent No.: US 6,739,533 B2
(45) Date of Patent: May 25, 2004

(54) METHOD FOR RECOVERY OF COMPRESSION WOOD AND/OR NORMAL WOOD FROM OVERSIZE CHIPS

(75) Inventors: Christer Eckerman, Jurku (FI); Bjarne Holmbom, Jurku (FI)

(73) Assignee: Oy Separation Research AB, Turku (FI)

( * ) Notice: Subject to any disclaimer, the term of this patent is extended or adjusted under 35 U.S.C. 154(b) by 0 days.

(21) Appl. No.: 10/343,237

(22) PCT Filed: Aug. 2, 2001

(86) PCT No.: PCT/FI01/00691

§ 371 (c)(1),
(2), (4) Date: Jan. 30, 2003

(87) PCT Pub. No.: WO02/09893

PCT Pub. Date: Feb. 7, 2002

(65) Prior Publication Data

US 2003/0145905 A1 Aug. 7, 2003

(30) Foreign Application Priority Data

Aug. 2, 2000 (FI) ..... 20001739

(51) Int. Cl.[7] ..... B27K 7/00; B27L 11/00
(52) U.S. Cl. ..... 241/28; 241/24.2
(58) Field of Search ..... 241/20, 21, 24.1, 241/24.12, 24.15, 24.2, 28; 209/162, 163, 173

(56) References Cited

U.S. PATENT DOCUMENTS

| | | | | | |
|---|---|---|---|---|---|
| 3,708,063 | A | * | 1/1973 | Morimasa | 209/3 |
| 3,822,015 | A | * | 7/1974 | Hsieh et al. | 209/173 |
| 3,878,994 | A | * | 4/1975 | Tee | 241/20 |
| 4,036,440 | A | * | 7/1977 | Makila et al. | 241/20 |
| 5,577,671 | A | | 11/1996 | Seppanen et al. | 241/14 |
| 5,964,355 | A | * | 10/1999 | Raura | 209/20 |
| 5,970,783 | A | * | 10/1999 | Levie et al. | 73/73 |
| 6,175,092 | B1 | | 1/2001 | Binette et al. | 209/587 |
| 6,260,777 | B1 | * | 7/2001 | Seppanen | 241/19 |

FOREIGN PATENT DOCUMENTS

| | | |
|---|---|---|
| FI | 74493 | 10/1987 |

* cited by examiner

*Primary Examiner*—Ed Tolan
(74) *Attorney, Agent, or Firm*—James C. Lydon

(57) ABSTRACT

A method for recovery of branch knot wood and/or normal wood from oversize chips in which the oversize chips are ground to splinter, which then is dried and mixed with water, and then the sedimented splinter containing high concentrations of extractive substances and having a high specific weight is recovered and extracted in order to recover valuable extractive substances, particularly lignans. The lighter splinter floating up to the water surface is recovered in order to recover normal wood material for the pulp production.

13 Claims, 1 Drawing Sheet

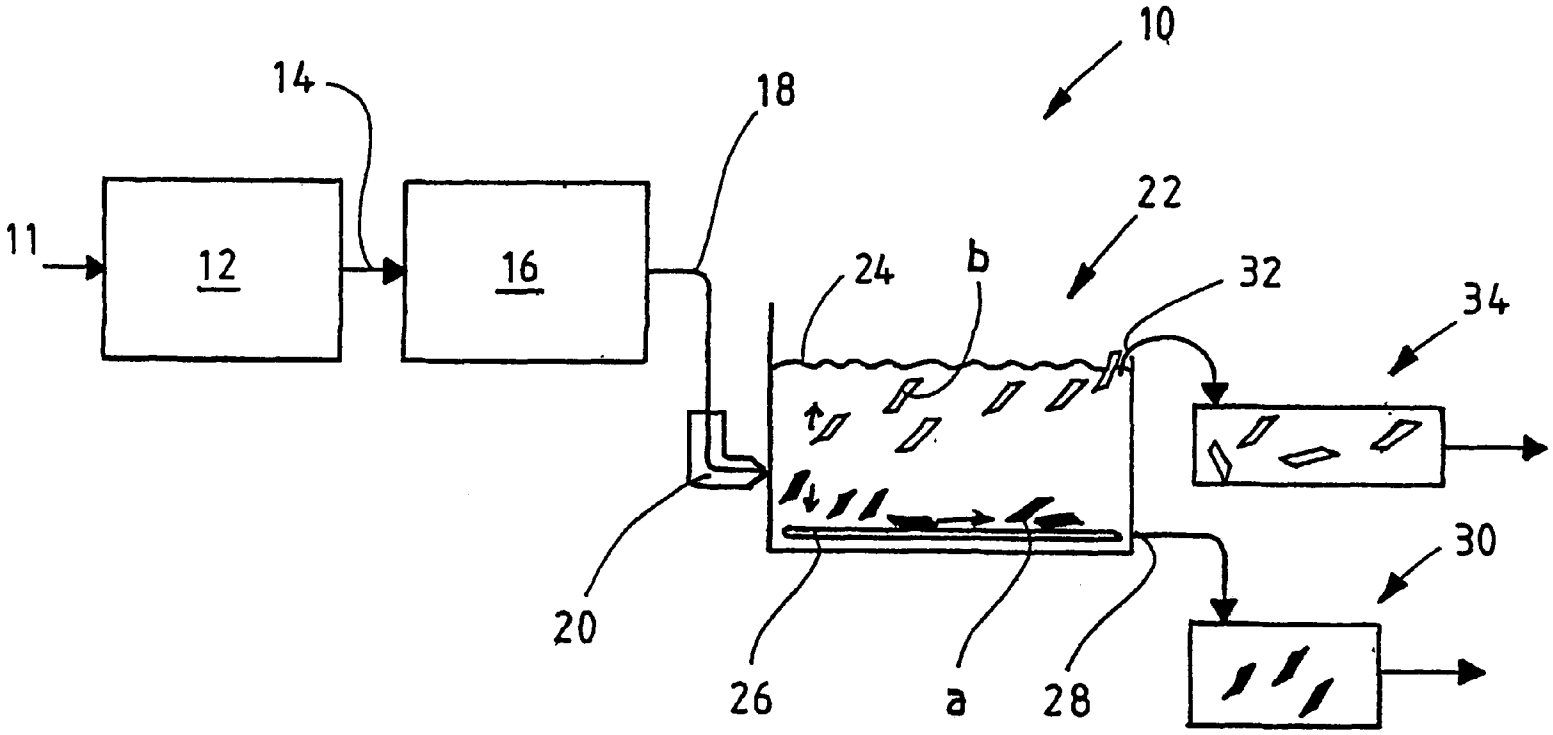
10
11
12
14
16
18
20
22
24
26
28
30
32
34
a
b

METHOD FOR RECOVERY OF COMPRESSION WOOD AND/OR NORMAL WOOD FROM OVERSIZE CHIPS

This application is a U.S. National Stage of International application PCT/FI01/00691, filed Aug. 2, 2001.

The invention relates to a method for recovery of branch knot wood and/or normal wood from oversize chips, according to the preamble of the enclosed independent claim.

Branches and limbs of a tree have their origin within the tree trunk. This inner part of a branch or limb is called a branch knot or an internal branch. The branch knot starts at the pith at the centre of the trunk and continues outwards to the periphery of the trunk, and then it extends as an external branch. The branch knot's diameter in the trunk increases towards the periphery of the trunk. Limbs which have dried out and have fallen or which have been cut away may end within the trunk and become enclosed by normal stem wood.

The morphology and the chemical composition of the branch knots differ from those of the normal stem wood. The fibres in the branch knots are shorter and they have thicker walls than the normal stem wood. For instance in spruce the branch knots' fibres have a length of about 1 mm, while in normal stem wood their length is 2 to 4 mm. The lower part of a branch knot differs from its upper part regarding the morphology. In softwood the lower part comprises so-called compression wood having fibres with thick walls and a circular cross-section. The compression wood contains more lignin but less cellulose than normal wood. The upper part contains fibres which are more like normal wood. In hardwood it is the upper part that differs from the normal wood the most. The upper part comprises so-called tension wood which contains more cellulose and less lignin than normal wood. However, the main part of the branch knot comprises pith wood with a low moisture content. The surrounding sapwood, on the contrary, has a high moisture content, even over 70%.

When trees are pruned the branch knots, i.e. the base parts of the branches or limbs remain in the trunk, and thus they will end up in the chips.

The branch knots are characterised by a high content of so-called extractive substances, which primarily protect the trees against fungus and microbe attacks, if the branch is broken or if it dries and falls off. In pines the branch knots contain up to 20–30% resin, which mainly comprises resin acids solved in a mixture of monoterpene hydrocarbons. There exists further phenolic substances, primarily pinosylvine and pinosylvinemethylether. Branch knots of spruce contain generally no more resin than normal wood, but they contain up to 20% phenolic substances of the so-called lignan-type. The main component, hydroxymatairesinol, which in Nordic spruce (Picea abies L.) constitutes 5 to 7% of the branch knots, has proved to have very strong antioxidative and anticarcinogenic characteristics. Also in hardwood the branch knots have a high content of phenolic extractive substances.

When felling trees the branches are cut away from the trunk, both when felling sawn timber and when felling pulp wood for paper and board production. On the other hand, the branch knots remain in the trunks. Their proportion of the trunk wood varies widely between different timber species, and also between different trees of the same species. Normally the branch knots form between 1 and 5% of the weight of the stem wood.

At the production of sawn timber the outer part of the trunk becomes waste, which usually is cut to chips and then supplied to a pulp plant or to the production of energy. At thermomechanical and chemi-thermomechanical pulp production the wood is first cut to chips and then defibered in a disc refiner. Also in chemical pulping the process starts with wood cut into chips. However, at groundwood and pressurised groundwood pulp production the source material is debarked stem wood.

As the wood is cut to chips the branch knots will form large chip lumps, so-called oversize chips. The hard branch knots are separated as such, together with more or less normal wood. Usually the chips are screened, it has thereby been observed that even more than 90% of the branch knots remain in the oversize chips fraction. The standard procedure is to cut the oversize chips once more in a special chipper, and return the chips to the chip screening. This means that practically all branch knot material eventually will be supplied to the fibre production. A separation of the whole oversize chip fraction will not be economically reasonable, as it usually constitutes 5 to 10% of the total amount of the chips. In certain pulp mills requiring particularly clean chips, a small part of the branch knot material is separated by air screening.

The branch knots provide due to their short and thick fibres a weak pulp for the production of paper and board. The branch knot material is further difficult to defiber, as they can not be impregnated by the cooking liquor or by water. In chemical pulp cooking the cooking liquor poorly penetrates into the knots, and knots remain in the pulp after the cooking in the form of splinter or even larger lumps. In mechanic pulp production the branch knots are not defibered at all in practice, but they are ground to a slime-like pulp (TAPPI Journal 78:5, 1995, pp. 162–168). The higher the proportion of branch knots in the chips, the weaker a pulp is obtained. The branch knots contain substances which absorb light and therefore provide a darker pulp which is difficult to bleach to a high brightness.

The high amount of extractive substances in the branch knots will cause additional problems in the production of pulp and paper. The resin components cause big problems by forming sticky deposits, particularly on paper machines. The extractive substances also result in an increased consumption of chemicals during cooking and bleaching. They can also generate condensation reactions with the chemicals, and thus completely inhibit delignification and fibre separation.

In order to summarise it can be stated that branch knots are undesirable in the production of pulp and paper, and that they should be screened out. The problem is that the known screening methods are not sufficiently selective, so that only branch knots, and then particularly their pith part could be screened out, without losing valuable normal stem wood.

Another reason for screening out the branch knot material is that it contains high amounts of valuable extractive substances. As an example can lignans in spruce be mentioned, the main component of the lignans being hydroxymatairesinol, which is a particularly interesting bioactive substance. Branch knots of pine contain bioactive stilbenes and other phenolic substances. In addition there exist very high amounts of resin, whereby the branch knots can be utilised e.g. in the production of so-called wood rosin. Such wood rosin is produced at a smaller scale from pine stubs, but it is difficult and expensive to pull out the stubs and to further process them for the extraction.

It is previously known to separate branch knots from production-chips by thickness screening. Namely, it has been found that the larger part of the oversize fraction contains knots, and that about 90% of the knot material is concentrated there (STFI-kontakt Nr 4, 1987, pp. 6–7; and TAPPI Journal 78:5, 1995, pp. 162–168). Thus pulp production, particularly the production of mechanical pulp and thermomechanical pulp can be facilitated, and the quality of the pulp be improved, while the separated branch knot material is used for the production of energy by combustion.

However, the separation of the branch knot material from normal wood will increase the costs of the pulp production, and it may not be that the achieved advantages motivate such a cost increasing measure. However, further advantages can be achieved if it was possible in a simple and economical manner to recover the extractive substances contained in the branch knot material in such high amounts.

It is previously known that pith wood, and particularly branches, contain a high amount of lignans (R. Ekman, Holzforschung 30, 1976, pp. 79–85; and Acta Academiae Aboensis Ser B, 39, 1979, pp. 1–6). Lignans exist in all softwoods and particularly in the pith of pine and spruce, which contain i.a. hydroxymatairesinol with a cancer preventing effect, and which can be used in pharmaceutical preparations and as additives in functional food.

The object of the present invention is thus to provide a simple and cost effective method for concentrating branch knot material and/or normal wood from oversize chips. Then the object is for instance to concentrate branch knot material in such a high proportion that it will be economically profitable to recover extractive substances from this material.

The object of the present invention is attained by methods which have the characteristics of the enclosed independent claims.

According to the invention so-called oversize chips is used as source material, which oversize chips already in itself contains much branch knot material and which thus is first ground to form splinter which is dried, and the splinter is mixed with water and left to stand for a while so, that heavy splinter with a high specific weight and a high content of extractive substances can settle on the bottom while the light splinter, mainly containing normal wood, will remain floating and can be separated in a simple way from the sedimented splinter, which then are recovered. The light and dry splinter does not have time to become soaked by water to the degree that also it would sink to the bottom, but it remains floating on the surface of the water, and after the separation it can be supplied to the pulp production, i.e. it can be recovered for the pulp production.

Thus the chips are first screened in order to separate the so-called oversize chips, which thereafter is ground to provide splinter. The content of branch knot material in the chips is very much concentrated in chips of exceptionally large dimension, both regarding the length but particularly regarding the thickness, as the branch knots are tough and hard and thus difficult to beat into chips.

According to a preferred embodiment according to the invention the concentration of branch knot material in the oversize chips may be further suitably substantially increased by air density separation of the oversize chips in a strong air flow, whereby the heavy chips with a higher concentration of branch knot material will be separated from the lighter chips with a higher content of normal wood, which then can be supplied to the production of chemical or mechanical pulp production or possibly to combustion.

The oversize chips, advantageously air density separated, are preferably ground to splinter having a length of about 5 to 70 mm, advantageously 5 to 30 mm, and a thickness of 2 to 10 mm, advantageously 2 to 7 mm, whereafter the splinter can be easily dried to a suitable dry matter content. The splinter is preferably dried to a dry matter content of at least 85%, advantageously to 87%.

The dried splinter is mixed with water in a water tank or the like, advantageously by supplying the splinter into the water at a location below the water surface. A separation of heavy and light splinter occurs in the water. The heavy splinter, i.e. the splinter with a high specific weight, are sedimented and sink lower in the water, while the lighter splinter, i.e. the splinter with a low specific weight, will rise towards the surface of the water.

The separation is rapid. A retention time of <2 minutes is often sufficient to create a satisfactory separation. For spruce or pine a retention time of 10 seconds to 1 minute has been found suitable. The water temperature may be relatively low, generally <60° C., advantageously <50° C., typically 15 to 30° C.

The sedimented splinter with very high concentrations of extractive substances will be suitably further comminuted before they are subjected to extraction in order to recover their contents of valuable extractive substances.

In this context oversize chips means chip bodies having a length and particularly a thickness, which already by visual observation clearly exceeds the dimensions of the average production-chips. Typical dimensions for oversize chips are a thickness of about 8 to 40 mm, while the length can be up to about 500 mm. The oversize chips have in general an irregular form, and their structure reveals easily that they contain branch knots or fractions of them.

Thanks to the present invention it is now possible to recover very pure branch knot material. The branch knot material recovered with the present invention can be extracted directly, without any further processing for recovering the valuable extractive substances. The grinding performed provides a sufficiently fine material for effective extraction, which can be made with hot water or organic diluents, depending on which components are desired to be recovered.

On the other hand, the wood material is still so coarse that the material fraction which is separated and contains a high proportion of normal wood can be recovered and supplied to the pulp production where it provides adequate quality to the pulp. The branch knot material is essentially darker than the normal wood, and at bleaching it requires more chemicals than the normal wood. Thus the removal of the knot material from the oversize chips makes it possible to recover this wood material for the production of pulp and to reach a higher brightness at the bleaching of the pulp.

In the following the invention is described with reference to the enclosed drawing. The drawing shows schematically a plant 10 according to the invention for processing oversize chips 11 or any other corresponding wood material. The oversize chips originate for instance in the production of TMP or thermomechanical pulp, in the production of CTMP or chemimechanical pulp, or chemical pulp. The oversize chips are supplied in the plant 10 to a grinding equipment 12 for grinding it to splinter. One part of the splinter, the heavier splinter a, will have a higher specific weight than another part of the splinter, the lighter splinter b. The ground splinter 14 is supplied to a drying device 16 for the drying of the splinter material to a suitable dry matter content. Then the dried splinter 18 is supplied, for instance with the aid of a screw conveyor 20 or the like to a sedimentation tank 22 or any other corresponding water basin or tank. The splinter is supplied to the water so that unnecessary supply of air is avoided. The supply is effected at a point below the water surface 24. In the sedimentation tank the heavier splinter a belonging to a splinter fraction with a higher specific weight will sink to the bottom of the tank, while the lighter splinter b will float up to the water surface. On the bottom of the tank 22 there is arranged a conveyor 26, which conveys the splinter fraction with the heavier splinter a accumulated on the bottom to an outlet 28 and further to a collecting plant 30. At the upper part of the tank 22, approximately at the water surface, there is arranged an overflow opening 32, through which that material which floats up to the surface, i.e. the lighter splinter b is discharged from the tank. The fraction of the lighter splinter b, which in this way is separated from the heavier splinter a, is then supplied to a recovery plant 34.

The material which is collected in the collecting plant 30 contains splinter which have substantially higher concentrations of extractive substances than the splinter in the other recovery plant 34, and therefore it can be utilised for the recovery of the extractive substances. On the other hand the material accumulated in the recovery plant 34 is relatively pure wood material, without any interfering substances, and therefore it can be returned to the pulp production.

In the following the method according to the invention is described in more detail with the aid of the embodiment examples below.

EXAMPLE 1

Oversize chips was taken from a TMP line (thermechanical pulp line) when it had passed through chip screening and Air Density Separation (ADS). Then it was ground in a small chipper to small splinter, corresponding to those splinter chips which are normally obtained when oversize chips are ground in order to be returned to the TMP process. The splinter was air dried to a dry matter content of about 90%.

The air dried splinter was mixed with cold water in a basin, and left to stand there for about 1.5 minutes. The fraction which floated up to the surface was removed, and then the water was decanted, and the sedimented fraction was recovered. Both fractions were dried and weighed. The test was performed three times. The weighing of the dry fractions showed that on average 26% of the splinter sunk to the bottom, whereas 74% of the splinter floated to the surface.

The fractions were extracted separately in a Soxhlet device with acetone, and the extracts were analysed in a gas chromatograph in order to quantitatively determine the concentrations of lignan. Samples of the water which was used in the sedimentation were also analysed. The results of the analyses are summarised in the table below, which presents the lignan distribution after the water fractionating:

TABLE

| Fraction | Distribution of lignan, % of the total amount | Lignans, % of the fraction |
|---|---|---|
| Sedimented splinter | 81.5 | 9.7 |
| Floating splinter | 17.4 | 0.7 |
| Water | 1.1 | — |

The sedimented splinter had a noticeably darker colour, and the high lignan content (9.7%) shows that the splinter in practice consisted of only pith wood from branch knots. The floating splinter was almost as bright as normal wood, but it appeared to contain rests of the branch knot pith, judging from the lignan contents. Only a small portion of the lignans were solved in the water phase.

In the above-described manner material of branch knot pith was obtained, which material is very well suited for the recovery of valuable extractive substances, particularly lignans. After extraction with e.g. acetone or ethanol the rest can be supplied to combustion for the production of energy.

As the floating splinter is wet, it can directly be returned to the production of thermomechanical pulp fibres.

EXAMPLE 2

Manually sorted oversize chips of pine (Pinus sylvestris) were fractionated according to the same method as above, whereby the result was that 42% of the splinter was sedimented and 58% of the splinter floated up to the surface. A chemical analysis of the fractions showed that the sedimented splinter contained practically pure branch knot pith wood, whereby the floating splinter contained only rests of the knot pith.

EXAMPLE 3

Oversize chips of different wood species, which all are used for the production of pulp fibres, were fractionated separately according to the same method as in Example 1. The wood species were Abies balsamea, Pinus contorta, Picea sitchensis, Picea glauca and Abies sibirica. Analysis of the fractions showed that 85 to 100% of the branch knot material could be concentrated in separate fractions, which consisted almost only of branch knot wood.

These examples show that the present invention is very well suited for the concentration of branch knot pith wood from softwood for recovering potentially valuable extractive substances, such as lignans, flavonoids, stilbenes, tannins, isoflavonoids, and phenolic acids. With a high probability the invention can also be used for the concentration of branch knot material from hardwood, while the knots usually have a higher density than the surrounding normal stem wood.

It is easy to realize that the fractionating method described here can be effected as a continuous process with conventional sedimentation-flotation techniques.

What is claimed is:

1. A method for recovery of branch knot wood from oversize chips, comprising grinding the oversize chips to splinter, drying the splinter, mixing the dry splinter with water, and recovering sedimented splinter containing high concentrations of extractive substances and having a high specific weight.

2. The method of claim 1, wherein the oversize chips are screened with a strong air stream in order to separate a chip fraction with an increased specific weight, which only then is ground to splinter.

3. The method of claim 1, wherein the oversize chips are ground to splinter having an average length of 5 to 70 mm, and a thickness of 2 to 10 mm.

4. The method of claim 3, wherein said splinter has an average length of 5 to 30 mm and a thickness of from 2 to 7 mm.

5. The method of claim 1, wherein the splinter is dried to a dry matter content of at least 85%.

6. The method of claim 5, wherein said splinter is dried to a dry matter content of at least 87%.

7. The method of claim 1, wherein the sedimented splinter is fractioned and extracted in order to obtain at least one extractive substance selected from the group consisting of lignans, flavonoid, stilbens, tannins, isoflavonoids and phenolic acids at a dry matter content of at least 85 %, advantageously at least 87 %.

8. The method of claim 7, wherein said extractive substance has a dry matter content of at least 87%.

9. A method for recovery of normal wood for the production of pulp from oversize chips, comprising grinding the oversize chips to splinter, drying the splinter, mixing the dry splinter with water, so that splinter rich in extractive substances and having a high specific weight is sedimented, and so that splinter rich in normal wood and having a lower specific weight will float up to the water surface, separating the splinter which is sedimented in the water from the splinter floating up to the water surface and having a lower specific weight, and recovering the splinter floating up to the water surface.

10. The method of claim 9, wherein the oversize chips is ground to splinter having an average length of 5 to 70 mm and a thickness of 2 to 10 mm.

11. The method of claim 10, wherein said splinter has an average length of 5 to 30 mm and a thickness of 2 to 7 mm.

12. The method of claim 9, wherein the splinter is dried to a dry matter content of at least 85%.

13. The method of claim 12, wherein said splinter is dried to a dry matter content of at least 87%.

* * * * *